US006142217A

United States Patent [19]

Haussmann

[11] Patent Number: 6,142,217

[45] Date of Patent: Nov. 7, 2000

[54] MOTOR VEHICLE FLAT TUBE HEAT EXCHANGER WITH FLAT TUBES RETAINED ON COLLARS OF A TUBE BOTTOM

[75] Inventor: Roland Haussmann, Wiesloch, Germany

[73] Assignee: Valeo Klimatechnik GmbH & Co., KG, Germany

[21] Appl. No.: 09/214,483

[22] PCT Filed: May 5, 1998

[86] PCT No.: PCT/EP98/02640

§ 371 Date: Jan. 5, 1999

§ 102(e) Date: Jan. 5, 1999

[87] PCT Pub. No.: WO98/50749

PCT Pub. Date: Nov. 12, 1998

[30] Foreign Application Priority Data

May 7, 1997 [DE] Germany ..... 197 19 259

[51] Int. Cl.[7] ..... F28F 9/22

[52] U.S. Cl. ..... 165/76; 165/174; 165/176; 165/178; 165/906

[58] Field of Search ..... 165/76, 153, 173, 165/174, 178, 906, 176

[56] References Cited

U.S. PATENT DOCUMENTS

| | | | |
|---|---|---|---|
| 1,847,743 | 3/1932 | Anderson . | |
| 5,105,877 | 4/1992 | Ando | 165/178 X |
| 5,183,107 | 2/1993 | Le Gauyer . | |
| 5,479,985 | 1/1996 | Yamamoto et al. | 165/153 X |
| 5,535,821 | 7/1996 | Potier | 165/173 |
| 5,605,191 | 2/1997 | Eto et al. | 165/76 X |
| 5,901,784 | 5/1999 | Potier | 165/173 |

FOREIGN PATENT DOCUMENTS

| | | | |
|---|---|---|---|
| 0 108 958 | 11/1982 | European Pat. Off. . | |
| 0 512 903 | 11/1992 | European Pat. Off. . | |
| 0 656 517 | 6/1995 | European Pat. Off. . | |
| 34 25 382 | 2/1985 | Germany . | |
| 63-127094 | 5/1988 | Japan | 165/178 |
| 3-1097 | 1/1991 | Japan | 165/173 |

*Primary Examiner*—Leonard Leo
*Attorney, Agent, or Firm*—Morgan & Finnegan, LLP

[57] ABSTRACT

The invention refers to a flat tube heat exchanger for motor vehicles in which the flat tubes leaving an internally projecting free end as an overhand are inserted in collars which extend to the inside and which are opened up in the form of a tulip of slits of a tube bottom of a header case for the internal heat exchange fluid and the header case comprises at least one partition dividing off various chambers of the header case and intersecting the flat tubes, the partition reaching at least down to the ground of the tube bottom adjacent to the flat tubes or to the collars extending to the inside and comprising in the region of the free ends of the flat tubes in the header case recesses overgripping the free ends, and the free ends of the first tubes in the header case being arranged with an undercut with respect to the collars opened up as a tulip which locks the flat tubes against being pulled out of the tubes bottom. According to the invention it is provided that the free ends of the flat tubes are pressed into the ground of the respectively allocated recess with compensation for tolerances such that the material displacement of the wall of the flat tube forms the undercut at its free end.

15 Claims, 3 Drawing Sheets

MOTOR VEHICLE FLAT TUBE HEAT EXCHANGER WITH FLAT TUBES RETAINED ON COLLARS OF A TUBE BOTTOM

BACKGROUND OF THE INVENTION

The invention relates to a flat tube heat exchanger for motor vehicles with the features of the precharacterizing part of claim 1. Such a flat tube heat exchanger is known from the EP-A1-0 656 517.

In the known flat tube heat exchanger, at the end of the flat tube flaps are bent around collars opened up in the form of a tulip of insertion slits of a tube bottom for the flat tubes by means of special pressing tools. It is true that this results in a reliable mounting, but the corrresponding assembly is inconvenient and requires two steps. In the first step, the tube bottom is placed upon the tube-fin-package, the flaps at the tube ends being at the same time bent over the collars opened up in the form of a tulip by means of special pressing tools. In the second step, the cap has to be placed upon the tube bottom.

BRIEF SUMMARY OF THE INVENTION

The object underlying the invention is to enable a one-step assembly, correspondingly securing the flat tubes in the tube bottom against pulling. In the process, one has to observe that the security against pulling is primarily only necessary before soldering or brazing the complete heat exchanger, so that even smaller degrees of security against pulling can be accepted.

This assembly is rendered possible in a flat tube heat exchanger with the features of the precharacterizing part of claim 1 by the characterizing features thereof.

In the flat tube heat exchanger according to the invention, it suffices to press the header case already preassembled from tube bottom and cap onto the ends of the flat tubes in one step, whereby at these ends a material deformation with a yielding of wall material to the outside occurs, this wall material resulting in an undercutting security against pulling, i.e. against pulling the flat tubes out of the tube bottom.

It is generally known to carry out comparable material deformations by means of an expanding mandrel of a special tool (cf. e.g. DE-A1-24 48 332, DE-A1-41 12 431 and DE-A1-195 01 337). Such special tools with an expanding mandrel are dispensable according to the invention as the necessary undercutting expansion is inherently effected by the partition in the header case.

The subclaims 2 to 5 concern preferred further developments of this idea, in which the undercutting material displacement is even greater and can optionally be effected annularly. According to claim 2 or 3, in these developments additionally the structure of an expansion mandrel is embodied at the partition, which is advantageous but not absolutely necessary for the general teaching of the invention in the sense of claim 1.

According to claim 6, a preferred final assembly of a flat tube heat exchanger according to the invention, and in claim 7, a preferred embodiment as evaporator are referred to.

BRIEF DESCRIPTION OF THE DRAWINGS

The invention will be illustrated more in detail with schematic drawings and several embodiments as follows, wherein.

DETAILED DESCRIPTION OF DRAWINGS

Figure 1:
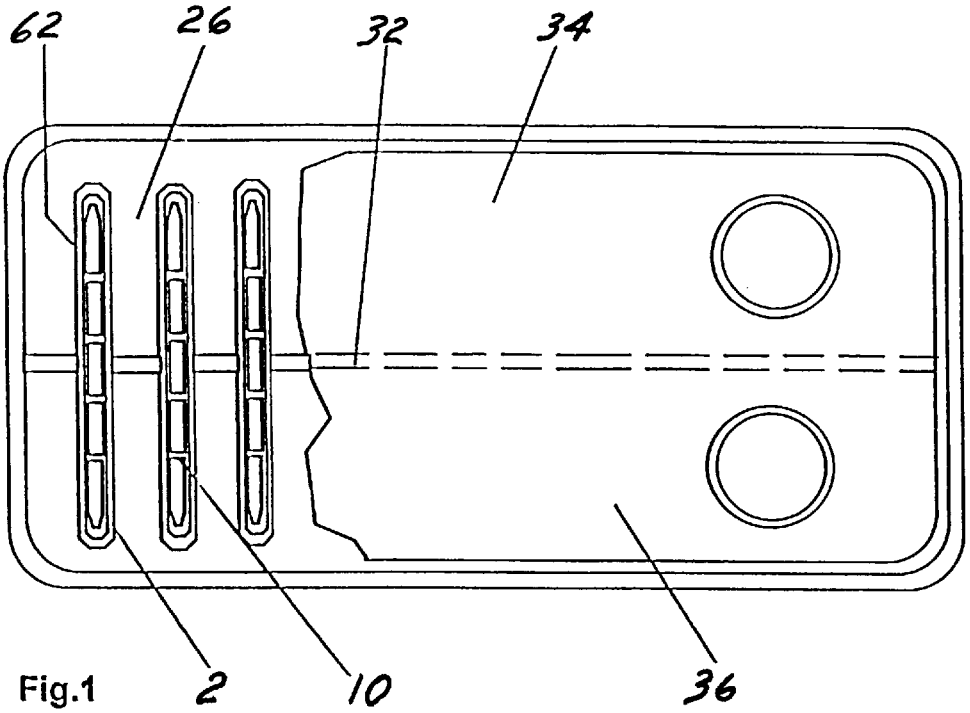
FIG. 1 is a plan view on a header consisting of tube bottom and cap of a double-flow flat tube heat exchanger with a partly fragmentary cap.
Figure 2:
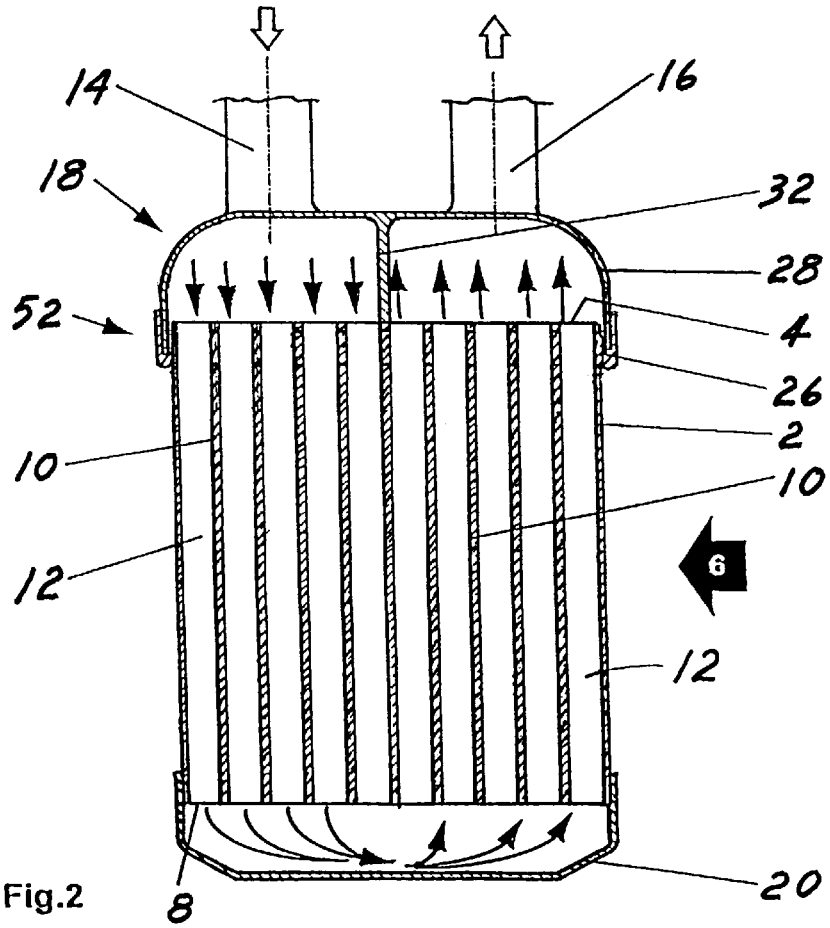
FIG. 2 is a cross-section through the double-flow flat tube heat exchanger provided with the header according to FIG. 1, showing a longitudinal section through the chamber or duct subdivision of a flat tube with a view on the external connections of the header.

The flat tube heat exchanger represented in FIGS. 1 and 2 has a double-flow design and is in particular intended as an evaporator of the refrigerant circulation of a motor vehicle air conditioning equipment plant.

This does not exclude to transfer the gist of the represented features to heat exchangers having a different number of flows, optionally also to those heat exchangers which do not serve as evaporators.

The general design of the flat tube heat exchanger is as follows:

A major number of typically twenty to thirty flat tubes 2 is arranged at constant distances to each other and with aligned front sides 4. Between the flat sides of the flat tubes each, a zig zag fin 9 is internested in a sandwiched fashion. A zig zag fin 9 each is furthermore arranged at the two outer surfaces of the outer flat tubes. Each flat tube comprises internal reinforcing webs 10, which division off chambers 12 in the flat tube acting as continuous ducts. Depending on the structural depth, a number of the chambers or ducts 12 of ten to thirty is typical.

The stated typical regions of the number of flat tubes and the chambers thereof is intended to be only a preferred number and is not intended to be restricting.

In a motor vehicle air conditioning equipment, in the final state outer air as an external heat exchange medium flows in the direction of arrow 6 shown in FIG. 2 in the direction of the structural depth through the block arrangement of the flat tubes 2 and the zig zag fins 9.

In the evaporator, a refrigerant, such as in particular fluorocarbon, serves as internal heat exchange medium which enters the flat tube heat exchanger via a supply line 14 and exits the heat exchanger via an outlet line 16. In the refrigerant circulation, the supply line 14 comes from the liquefier thereof. The outlet line 16 leads to the condenser of the refrigerant circulation.

With an even number of flows in the flat tube heat exchanger, the distribution of the refrigerant on the inlet side is effected from the supply line 14 to the individual flat tubes by a so-called distributor. On the outlet side, the refrigerant is supplied as a whole to the outlet line 16. Though it is possible to assign the distribution and the collection to separate boxes, in the shown double-flow embodiment both functions are combined in a common header 18, which serves as a header case for the inlet and the outlet side.

This header 18 is then arranged at a front side of the flat tubes 2, while at the other front side 4 of the flat tubes 2, a flow reverse takes place only between each of the flows, here for example by the individual bowls 20 illustrated in FIG. 2 or by integrating the deflecting functions of such individual bowls 20 in a common deflection header 22 (not shown). The individual bowls 20 according to FIG. 2, too, can be integrated by links (not shown) to form a modular unit, if necessary.

In flat tube heat exchangers with an uneven number of flows higher than one, the function of the bowls 20 or of a deflection header would be supplemented by the function of an outlet header.

The multi-flow design means at least one flow reverse in the region of the individual ducts formed by the chambers 12 in each flat tube 2. In the shown double-flow design, the bowl 20 or the deflection header 22 does then not need any further intermediate chamber subdivision, it is only necessary that a single deflection function is guaranteed. In case of a multiple deflection, at least in the bowl 20 or in the deflection header, at least one parting wall is necessary, so that in case of a four-flow design, a double simple deflection in the respective bowl 20 or deflection header is effected. In a design with an even greater number of flows, the number of parting walls optionally has to be further increased.

The header 18 is basically composed of a tube bottom 26 and a cap 28, and optionally further parts for assembling the header 18 can be provided.

The free ends of the tubes 2 opposite the bowls 20 or the deflection headers, respectively, tightly engage the tube bottom 26 in communication with the inner space of the header 18, which tube bottom is correspondingly provided with engaging slits 62 as well as with corresponding internal engaging muffs 64 and optionally external engaging muffs (not shown).

As in the double-flow header 18, the inlet function and the outlet function of the refrigerant are combined, the header 18 requires at least a two-chamber design which separates an inlet side from the outlet side. For this purpose, the chamber subdivision comprises at least one flat web in form of a longitudinal web 32, which separates the inlet chamber 36 in the header 18 communicating with the supply line 14 from an outlet chamber 34 continuously extending longitudinally of the header 18 and communicating with the outlet line 16.

In an evaporator, furthermore the supply of the refrigerant on the side of the inlet to all flat tubes 2 has to be as steady as possible. In a borderline case, the supplied refrigerant can be supplied to each individual flat tube 2 by a so-called distributor. In most cases, however, the supply is effected to adjacent groups of flat tubes, in which at least some groups comprise a number of flat tubes higher than one, wherein the number of flat tubes per group can also vary. An own inlet chamber (not shown) is assigned to each group of flat tubes, which chamber directly communicates with the respective group of the flat tubes 2. Such own inlet chambers are divisioned off from one another in the chamber subdivision by crosswise webs designed as flat webs.

In the represented double-flow evaporator, the crosswise webs would depart at a right angle only from one side of each of the longitudinal webs 32.

For example in a four-flow evaporator, apart from the longitudinal web 32 contiguous to the outlet chamber 34, another longitudinal web in parallel to this web is provided. This web is intersected at a right angle by the crosswise webs divisioning off the own inlet chambers of the groups of flat tubes up to the connection to the longitudinal web 32. In the allongation of the crosswise webs between the two longitudinal webs, then between each of these longitudinal webs an inner deflection chamber contiguous to the respective outer own inlet chamber for deflecting the second flow into the third flow is divisioned off within the header 18.

In case of greater numbers of flows which are guided through the header 18 with a deflection function, the number of the further longitudinal webs as well as the number of the inner deflection chambers increase correspondingly, the deflection chambers then being furthermore internested in the crosswise direction of the header situated internally and one next to the other between the own inlet chambers as well as the outlet chamber 34.

The supply line 14 communicates with each of the individual inlet chambers via an own supply line extending in the header 18.

In most cases, in the assembled heat exchanger the block of flat tubes 2 and zig zag fins 9 is laterally terminated by a side sheet metal in contact with each of the outer zig zag fins 9, such that the side sheet metals form an outer frame for the outer air flowing to the heat exchanger block according to arrow 6 in FIG. 2.

The flat tubes 2, the zig zag fins 9, the tube bottom 26 and the cap 28 of the header together with the optionally provided chamber subdivision as well as the side sheet metals of the heat exchanger consist, as well as conveniently the supply line 14 and the outlet line 16, of aluminum and/or an aluminum alloy and are brazed including the sections of the line connections adjacent to the flat tube heat exchanger to form the finished evaporator.

Without the invention being restricted thereto, in practice in refrigerant evaporators for motor vehicle air conditioning equipments, optionally the supply line 14 and the outlet line 16, which can pass over into the header 18 via corresponding connecting sleeves, are connected to two respective connecting sleeves of a thermostatically controlled block valve. At the opposite side, this valve then comprises two further connecting sleeves at the side of the inlet and of the outlet.

In the represented embodiments, the tube bottom 26 and the cap 28 are formed of sheet metal pre-coated with solder or braze, respectively. Here, the free edge of the cap 28 engages the tube bottom 26 with an overlap at least on one side—in FIG. 2, an overlap 52 on two sides is shown. The engaging muffs 64 are embodied from the sheet metal of the tube bottom 26 as collars of the slits 62, the collars being opened up towards the interior in the form of a tulip.

Figure 3:
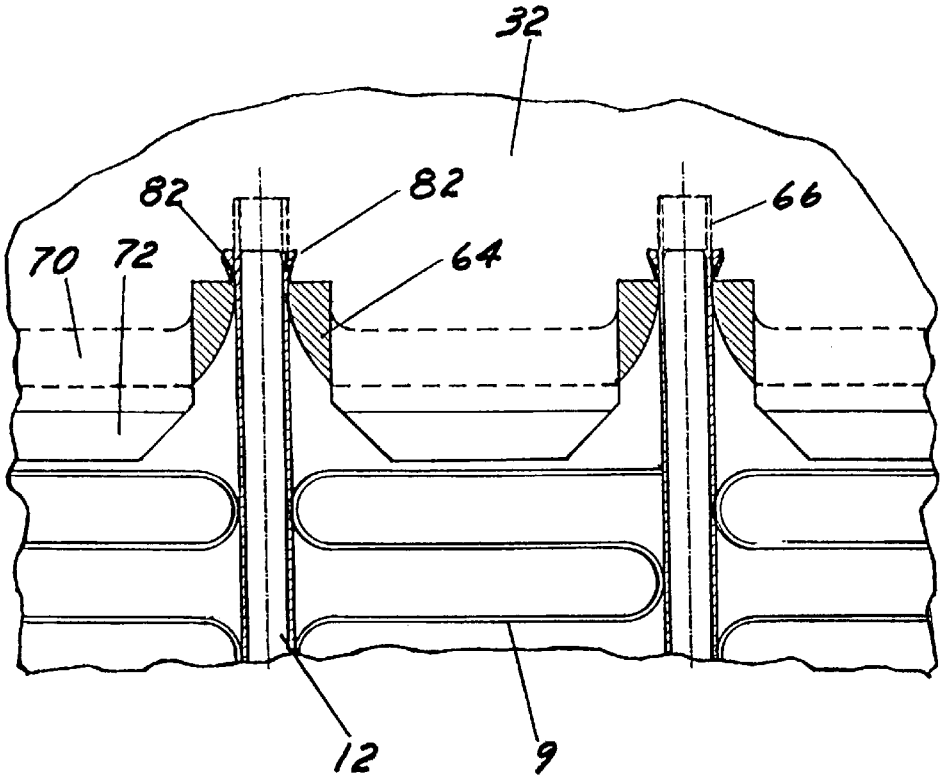
FIG. 3 is in an enlarged representation a partial section along the longitudinal wall in the cap of the header through its region of connection with the flat tubes in a first embodiment.
Figure 4:
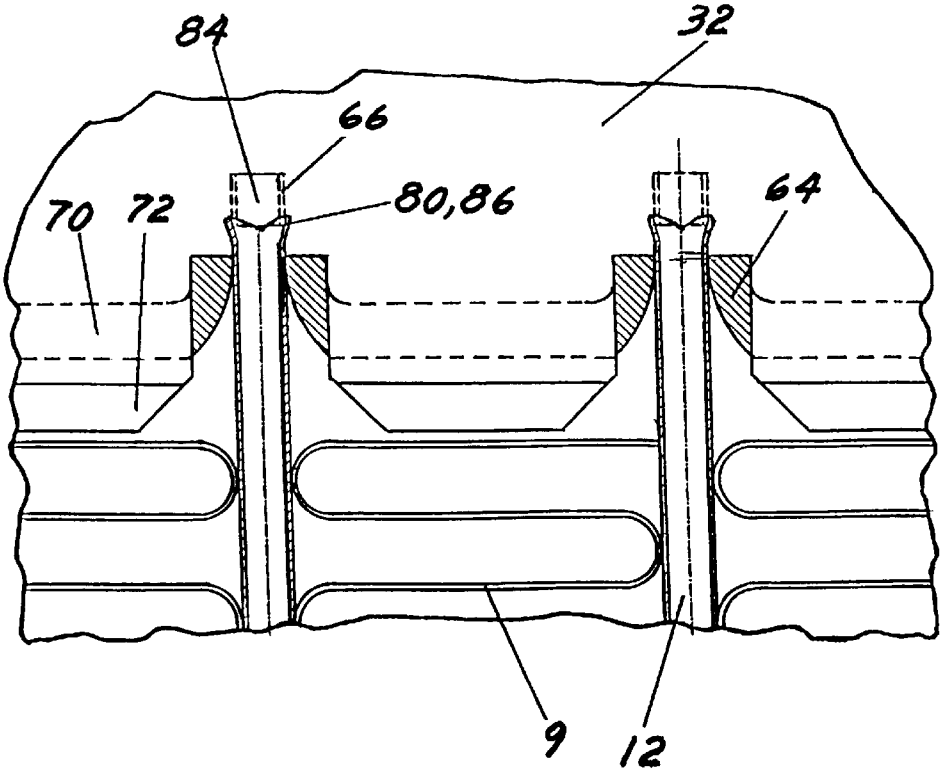
FIG. 4 is a representation as in FIG. 3 in a second embodiment, wherein the longitudinal wall in the cap intersects a chamber in the flat tube.
Figure 5:
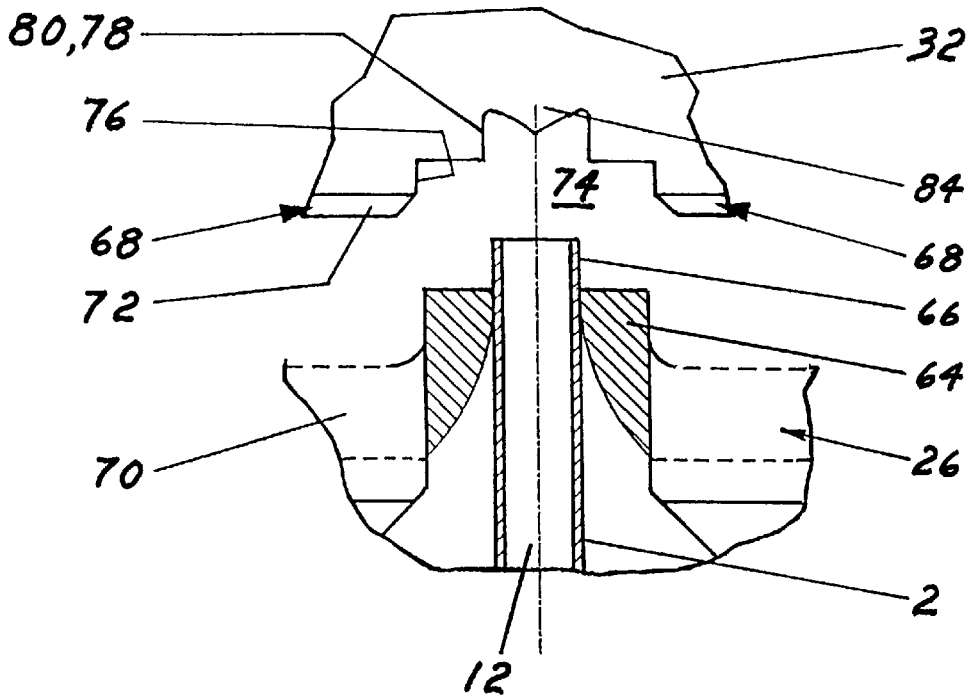
FIG. 5 is a partial view further enlarged with a section through the flat tube and a plan view on the longitudinal partition in the cap before assembling the assembled flat tube heat exchanger according to FIG. 4.

As can be seen in particular from FIGS. 3 to 5 and can be basically taken from FIG. 5, the flat tubes 2 inserted from the outside into the tube bottom 26 project through the engaging muffs 64 of the tube bottom into the interior of the header 18 with an internal overhang 66.

The longitudinal web 32 embodied in the cap 28 and separating the inlet chamber 36 from the outlet chamber 34 intersects the flat tubes 2. In order to tightly separate the inlet chamber from the outlet chamber by means of the longitudinal web 32, outside the engaging muffs 64 the longitudinal web 32 with a lower engaging edge 68 penetrates slits 70 in the tube bottom 26 extending crosswise to the slits 62 or engages internal grooves in the tube bottom 26 in a manner which is not shown. The region 72 penetrating the slits 70 is visible in FIGS. 3 and 4.

At each location where the longitudinal web 32 intersects a flat tube 2, in the free edge of the longitudinal web a stepped cut-out 74 (cf. in particular FIG. 5) is left open, of which the wide section 76 adjacent to the free edge of the longitudinal web 32 surrounds the engaging muff 64 and of which the narrow section 78 joining towards the interior at the bottom of the wide section 76 surrounds the engaging muff 64 with an internal overhang 66 of the flat tube 2. This relative arrangement is arranged so complementarily that during the brazing of the parts of the flat tube heat exchanger to one another a good brazing can also be effected in the region of the intersection of the longitudinal web 32 with the respective flat tube 2 in the region of the internal overhang 66 thereof as well as with the corresponding internal engaging muff 64.

The intersection of the longitudinal web 32 with the respective flat tube 2 can be effected either in the region of a reinforcing web 10 of the flat tube 2 separating two adjacent chambers 12 of the flat tube (cf. in particular FIGS. 1 and 6) or in the region of a chamber or duct 12 of the flat tube 2 (cf. FIGS. 3 to 5.).

Though the narrow section 78 of the stepped cut-out 74 can be at least nearly rectangular, it preferably extends towards the ground of the narrow section 78 with a conical expansion 80, as is particularly clearly shown in FIG. 5, and is at least indirectly indicated also in FIGS. 3 and 4.

In order to arrange the free ends of the flat tubes 2 in the header 18 situated in the respective internal overhang 66 with respect to the collars of the engaging muffs opened up in the form of a tulip with an undercut stopping a pulling out of the flat tubes 2 from the tube bottom 26, in the following solutions are described in which the mentioned free ends of the flat tubes 2 are pressed with compensation for tolerances into the ground of the respectively allocated narrow section 78 of the recess formed by the stepped cut-out 74, such that the material displacement of the wall of the flat tube 2 forms the undercut at its free end.

A two-sided local material displacement 82 due to the mentioned pressing only by the combined action of the overhang 66 of the respective flat tube 2 over the inner engaging muffs 64 with the narrow section 78 of the stepped cut-out 74 is shown in FIG. 3.

FIG. 4 shows that, if furthermore an expanding mandrel projects from the bottom of the narrower inner section 78 of the stepped cut-out 74 of the longitudinal web 32 into the stepped cut-out 74, which mandrel engages a chamber 12 of the respective flat tube 2 according to the lower representation in FIG. 5, another essentially greater material displacement 86 can be effected, as is achieved according to FIG. 4, where at the same time the conical expansion 80 of the narrower section 78 of the stepped cut-out 74 cooperates.

If the expanding mandrel 84 only extends longitudinally of the longitudinal web 32, as in case of FIG. 3, one only obtains a local material displacement on both sides of the flat tube 2, which then, however, results in an essentially greater security against pulling being a marked material displacement 86 according to FIG. 4.

If the expanding mandrel 84 is embodied in a rounded manner, the material displacement 86 can be distributed further around the longitudinal web 32.

Figure 6:
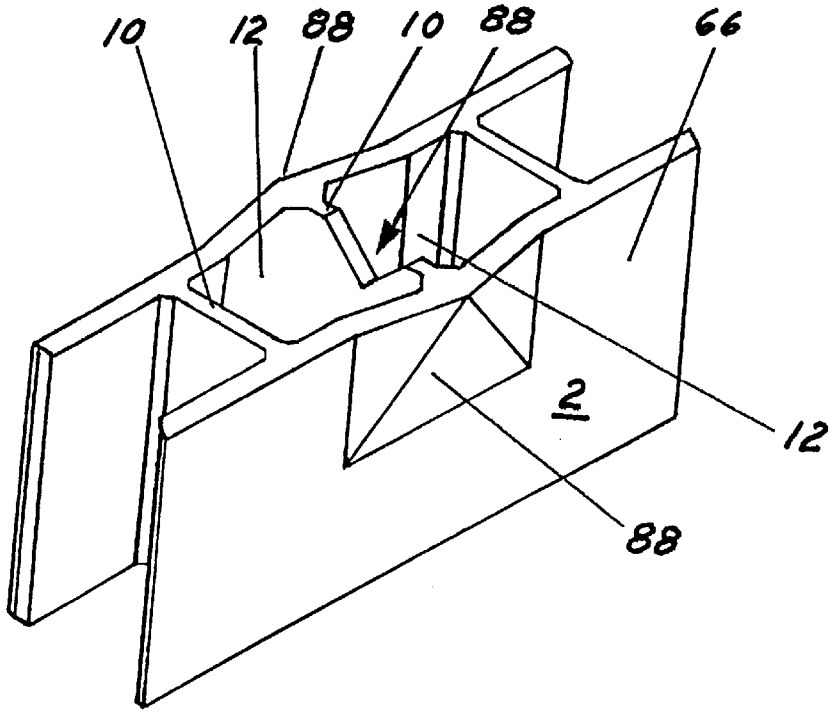
FIG. 6 is a perspective partial view of the front side of a flat tube for the case in which a longitudinal partition formed according to FIG. 5 in the cap does not act together with a chamber or duct, as in FIG. 4, but with a reinforcing web of the flat tube.

FIG. 6 shows the result of a modification in which with the same embodiment of the stepped cut-out 74 as in FIG. 5 a material displacement is effected with the expanding mandrel 84, if the expanding mandrel 84 does not engage a chamber 12 of the flat tube but encounters a reinforcing web 10 of the flat tube between two adjacent chambers. Then, according to FIG. 5, the reinforcing web is provided with a notch 88 at the free end of the free overhang 66 at the location, where the expanding mandrel 84 is applied. This leads to a material displacement, such that the side walls 88 of the flat tube situated in the region of this reinforcing web 10 serving as a parting wall form the undercut.

What is claimed is:

1. A flat tube heat exchanger for motor vehicles having a top end and a bottom end, a deflection header disposed over the bottom end, an inlet/outlet header having an inlet and an outlet disposed over the top end, a plurality of flat tubes extending between the deflection header and the inlet/outlet header, the inlet/outlet header further comprising:

a tube bottom having, for each said tube, a slit;

a cap defining with the tube bottom a header chamber;

a collar extending from each said slit into the header chamber; and at least one partition extending down from the cap to the tube bottom, wherein each said tube has a free end projecting through the collar and into the header chamber as a tulip-shaped overhang, wherein the partition includes a plurality of recesses adapted to overgrip the free ends of the flat tubes to secure the flat tubes to the tube bottom, and to form the tulip-shaped overhang when pressed with compensation for tolerances into the free ends of the flat tubes.

2. The flat tube heat exchanger of claim 1, wherein the partition includes an expanding mandrel adapted to engage a duct of said flat tube situated at an intersection point of the partition and said flat tube.

3. The flat tube heat exchanger of claim 1, wherein the partition includes an expanding mandrel adapted to engage a partition wall between adjacent ducts of said flat tube situated at an intersection point of the partition and said flat tube, and adapted to displace side walls of said tube to form the tulip-shaped overhang.

4. The flat tube heat exchanger of claim 1, wherein the recess is an undercut of the partition.

5. The flat tube heat exchanger of claim 4, wherein the undercut has is conical in shape.

6. The flat tube heat exchanger of claim 1, wherein the heat exchanger is made from a material selected from the group consisting of:

aluminum or aluminum containing alloys.

7. The flat tube heat exchanger of claim 6, further comprising a brazed plating adapted to solder together said flat tubes, the tube bottom and the partition.

8. An evaporator of a motor vehicle air conditioning system comprising a flat tube heat exchanger according to claim 1.

9. An inlet/outlet header for a flat tube heat exchanger comprising:

a housing defining a header chamber including an inlet, an outlet, and a plurality of openings, a collar surrounding each said opening and extending into the header chamber; and at least one partition dividing the header chamber into at least an inlet portion and an outlet portion, a plurality of recesses provided on the partition adapted to secure the flat tubes to the tube bottom, wherein each said recess is configured to displace walls of said tubes to form tulip-shaped overhangs when pressed with compensation for tolerances into an end of said tubes.

10. The inlet/outlet header of claim 9, wherein each said recess is an expanding mandrel adapted to engage a duct of said flat tube situated at an intersection point of the partition and said flat tube.

11. The inlet/outlet header of claim 9, wherein each said recess is an expanding mandrel adapted to engage a partition wall between adjacent ducts of said flat tube situated at an intersection point of the partition and said flat tube, and adapted to displace side walls of said tube to form the tulip-shaped overhang.

12. The inlet/outlet header of claim 9, wherein each said recess is an undercut of the partition.

13. The inlet/outlet header of claim 12, wherein each said undercut is conical in shape.

14. The inlet/outlet header of claim 9, wherein the inlet/outlet header is from a material selected from the group consisting of: aluminum or aluminum containing alloys.

15. The inlet/outlet header of claim 14, further comprising a brazed plating adapted to secure together said flat tubes, the tube bottom and the partition.

* * * * *